US012359511B2

(12) United States Patent
Denk et al.

(10) Patent No.: US 12,359,511 B2
(45) Date of Patent: Jul. 15, 2025

(54) DRILLING TOOL AND METHOD FOR PRODUCING A BORE IN THE GROUND

(71) Applicant: BAUER Maschinen GmbH, Schrobenhausen (DE)

(72) Inventors: Fabian Denk, Vohburg (DE); Robert Lauerer, Schrobenhausen (DE); Michael Stohl, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 18/719,587

(22) PCT Filed: Dec. 2, 2022

(86) PCT No.: PCT/EP2022/084183
§ 371 (c)(1),
(2) Date: Jun. 13, 2024

(87) PCT Pub. No.: WO2023/110450
PCT Pub. Date: Jun. 22, 2023

(65) Prior Publication Data

US 2025/0043636 A1 Feb. 6, 2025

(30) Foreign Application Priority Data

Dec. 15, 2021 (EP) ..... 21214859

(51) Int. Cl.
*E21B 10/32* (2006.01)
*E21B 7/00* (2006.01)
*E21B 7/20* (2006.01)

(52) U.S. Cl.
CPC ..... *E21B 10/327* (2013.01); *E21B 7/003* (2013.01); *E21B 7/20* (2013.01)

(58) Field of Classification Search
None
See application file for complete search history.

(56) References Cited

U.S. PATENT DOCUMENTS 2,873,950 A * 2/1959 Kandle ..... E21B 4/18 175/321
4,193,462 A * 3/1980 Blaschke ..... E21B 10/44 175/171

(Continued)

FOREIGN PATENT DOCUMENTS

CN 111911078 A 11/2020
CN 113236131 A 8/2021

(Continued)

OTHER PUBLICATIONS

International Search Report issued in PCT/EP2022/084183; mailed Feb. 1, 2023.

(Continued)

*Primary Examiner* — Kipp C Wallace
(74) *Attorney, Agent, or Firm* — Studebaker Brackett PLLC

(57) ABSTRACT

The invention relates to a drilling tool for producing a bore in the ground, comprising a rotatably drivable basic body, a removal means at a lower end of the basic body for removing soil material, and at least one adjustable removal element, which is adjustable between a radially inner retraction position and a radially outer extension position in which the removal element protrudes radially outwards relative to the basic body in order to widen a bore diameter. According to the invention it is provided that for adjusting the removal element, an adjustment mechanism with a rotary member is provided, which is rotatable on the basic body about the drilling axis between a first rotary position and second rotary position, that at least one removal element is arranged on a pivot arm which is pivotable relative to the basic body between a first pivot position, in which the at least one removal element is in its retraction position, and a second pivot position, in which the at least one removal element is in its extension position, and that an actuating cam is (Continued)

Figure 1:
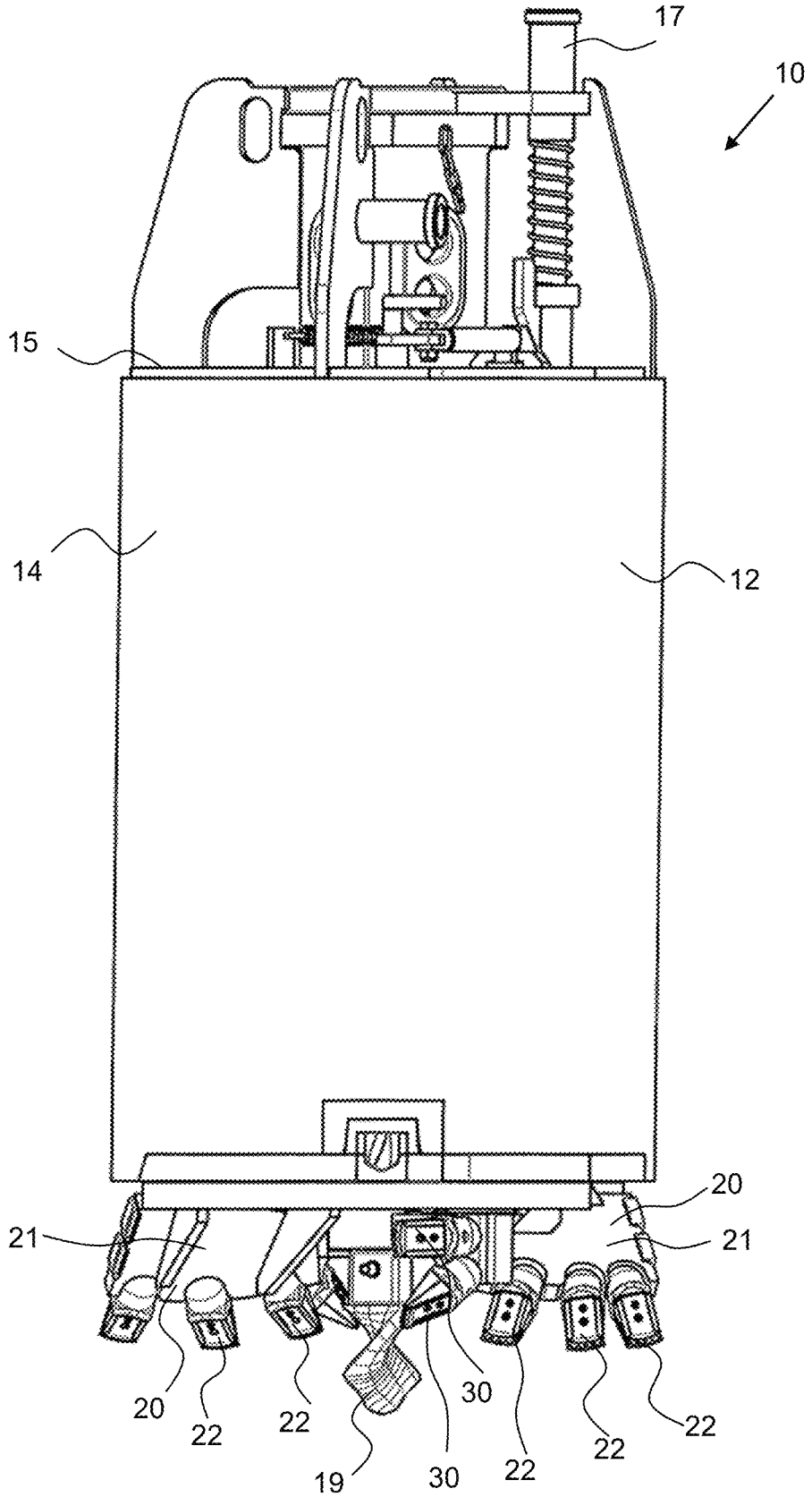

provided on the rotary member and/or on the at least one pivot arm, by means of which actuating cam a rotary movement of the rotary member can be converted into a pivot movement of the at least one pivot arm.

11 Claims, 6 Drawing Sheets

(56) References Cited

U.S. PATENT DOCUMENTS

| | | | | |
|---|---|---|---|---|
| 5,013,191 | A * | 5/1991 | Kitanaka | E21B 7/005 299/68 |
| 8,500,370 | B2 * | 8/2013 | Ditillo | E02D 5/36 175/232 |
| 2007/0251730 | A1 * | 11/2007 | Barbera | E21B 7/201 175/323 |
| 2011/0209921 | A1 * | 9/2011 | Barbera | E21B 10/66 175/336 |
| 2014/0238749 | A1 * | 8/2014 | Schweiger | E21B 10/32 175/57 |
| 2016/0251899 | A1 * | 9/2016 | Watson | E21B 27/00 175/161 |

FOREIGN PATENT DOCUMENTS

| | | | | |
|---|---|---|---|---|
| CN | 113445927 | A * | 9/2021 | E21B 10/00 |
| EP | 3505717 | A1 | 7/2019 | |
| JP | 3399514 | B2 * | 4/2003 | |

OTHER PUBLICATIONS

International Preliminary Report on Patentability and Written Opinion issued in PCT/EP2022/084183; issued Jun. 13, 2024.

* cited by examiner

DRILLING TOOL AND METHOD FOR PRODUCING A BORE IN THE GROUND

The invention relates to a drilling tool for producing a bore in the ground, comprising a rotatably drivable basic body, a removal means at a lower end of the basic body for removing soil material, and at least one adjustable removal element, which is adjustable between a radially inner retraction position and a radially outer extension position in which the removal element protrudes radially outwards relative to the basic body in order to widen a bore diameter.

The invention further relates to a method for producing a bore in the ground.

Such drilling tools are typically used for producing foundation piles in the ground. To support the ground during drilling, a supporting pipe is often introduced together with the drilling tool, which supporting pipe having a somewhat larger diameter than the drilling tool guided therein. To remove soil material directly through the supporting pipe, the latter can be provided at its lower end with a so-called cutting shoe with removal elements. These can be exposed to considerable wear, depending on the intended drilling depth. Unlike a drilling tool, the supporting pipe in principle cannot be withdrawn or can hardly be withdrawn again from the borehole while the process is ongoing, since otherwise the borehole would lose its necessary support for the further drilling process.

If the drilling tool runs ahead in respect of the following supporting pipe by a certain amount, it is also known to provide radially adjustable removal elements on the drilling tool. The radial removal elements can be extended into a region below the supporting pipe so that the soil material is removed directly below the supporting pipe. This considerably reduces wear of the supporting pipe and allows easier introduction of the supporting pipe into the ground. To withdraw the drilling tool from the supporting pipe, the radially adjustable removal element can be retracted again from its extension position via an adjustment device, so that the drilling tool can be withdrawn from the supporting pipe without collisions.

It is known to provide hydraulically operated actuating cylinders on the drilling tool for adjustment. However, this is mechanically complex, and also requires a rotary feedthrough to feed hydraulic fluid from the outside to the drilling tool rotating during operation. Furthermore, adjustment devices are known with which an axial actuating movement at the drilling tool, for instance by means of the axial drilling rods, is converted into a radial adjustment movement. The conversion of an axial movement into a radial movement is mechanically complex and requires a corresponding space in the limited installation space of a drilling tool.

The object underlying the invention is to specify a drilling tool and a method for producing a bore in the ground by means of which a radial change in diameter can be achieved in a simple and reliable way.

The drilling tool according to the invention, in which for adjusting the removal element, an adjustment mechanism with a rotary member is provided, which is rotatable on the basic body about the drilling axis between a first rotary position and second rotary position, wherein the at least one removal element is arranged on a pivot arm which is pivotable relative to the basic body between a first pivot position, in which the at least one removal element is in its retraction position, and a second pivot position, in which the at least one removal element is in its extension position, wherein an actuating cam is provided on the rotary member and/or on the at least one pivot arm, by means of which actuating cam a rotary movement of the rotary member can be converted into a pivot movement of the at least one pivot arm.

The drilling tool can in principle be configured as desired, for instance as a continuous screw, a drilling auger or as a bucket drill. A first aspect of the invention resides in that the at least one radially adjustable removal element is not just linearly adjustable in a radial direction but is mounted on a pivot arm pivotably between a retraction position and an extension position.

According to a further aspect of the invention, the adjustment mechanism comprises, for displacing the removal element, a rotary member, which is rotatable between a first rotary position and a second rotary position. For this, the rotary member and the at least one pivot arm are coupled to one another via an actuating cam so that a forced control is given. In this way, a defined pivot position of the pivot arm can be achieved with a defined rotary position of the rotary member.

Therefor, the rotary member is mounted rotatably about the drilling axis of the drilling tool so that rotation of the rotary member and thus pivoting of the pivot arm is effected depending on the rotation direction of the drilling tool. In this way, a forced control is achieved, in which the at least one removal element on the pivot arm is moved in a defined manner between the retraction position and the radial extension position. A simple and compact adjustment mechanism and thus a drilling tool of simple design with the possibility of radial extension of the diameter can thus be realized overall.

According to the invention is provided that the at least one actuating cam is configured as a pin. A particularly robust embodiment that can be produced in a simple way is achieved thereby. The pin preferably extends in the longitudinal direction of the drilling tool, that is, in the drilling direction and parallel to the drilling axis.

The pin can in principle be attached to the pivot arm and engage in a corresponding slotted guide on the rotary member. It is according to the invention for the actuating cam in the form of a pin to be attached to the rotary member and for a link hole, in particular a slot, into which the pin engages, to be formed in the at least one pivot arm. This allows a particularly robust and simple structure of the drilling tool.

A further robust configuration is achieved according to the invention in that at least one pivot pin is arranged on the basic body, on which pivot pin the at least one pivot arm is pivotably mounted. The pivot pin can here be fixed to the basic body, while the pivot arm is mounted pivotably on the pivot pin via a simple plain bearing. In principle, however, the pivot pin can also be attached fixedly to the pivot arm and engage in a corresponding sleeve-shaped pivot bearing on the basic body.

Particularly good functionality and force distribution are achieved according to a further embodiment variant of the invention in that two pivot arms are provided with at least one removal element in an opposing arrangement at the lower end of the basic body. For this, the pivot arms are offset arranged from one another approximately by 180° about the drilling axis. This substantially symmetrical configuration allows uniform force distribution in relation to the circumference.

It is particularly expedient according to a development of the invention that the basic body is in the form of a drum-shaped drilling case with at least one lower receiving opening and that the rotary member is in the form of a rotary base for opening and closing the at least one receiving opening. The drilling tool is thus in the form of a case drill or drilling bucket with a drum-shaped basic body. Such drilling buckets have a rotary base, which is mounted rotatably about the drilling axis, to open and close the at least one receiving opening. Such a rotary base can be used as a rotary member for the invention.

It is advantageous according to a preferred embodiment of the invention for the removal means to be arranged on the rotary base. The removal means can be formed here, in particular by cutting teeth which are arranged approximately linearly in a radial direction along the rotary base at the receiving opening.

For fast emptying of such a bucket drill or drilling bucket, it is preferred according to a further embodiment variant of the invention for a folding base to be arranged such that it can swing open on a lower region of the drum-shaped drilling case, on which folding base the rotary base is rotatably mounted. The folding base with the rotary base can thus be swung open about a substantially horizontal pivot axis or hinge axis which is oriented approximately perpendicular to the drilling axis. In this way, the underside of the drilling case can be opened so that soil material situated therein can be emptied simply.

According to a development of the invention, a particularly compact design of the drilling tool is achieved in that the at least one pivot pin on the basic body is formed as a stop for limiting the rotary movement of the rotary base. The rotary base can thus be formed with a limited rotation range or adjustment range, so that it exposes or covers the at least one receiving opening exactly.

Expedient operation of the drilling tool according to the invention is further achieved in that a cutout is formed in the at least one pivot arm to form a passage region for removed soil material. In particular, the pivot arm can have a region with reduced wall thickness in the direction of the drilling axis, so that a passage region for removed soil material is produced in a horizontal direction. This additionally simplifies pivoting of the pivot arm.

A further advantageous embodiment of the invention resides in that the at least one removal element is in the retraction position when the rotary base closes the at least one receiving opening in the drilling case, and that the at least one removal element is in the radially protruding extension position when the rotary base exposes the receiving opening.

During drilling operation with the receiving opening open, an extension of the diameter below a supporting pipe can thus be achieved when the drilling tool runs ahead. In this state, in-situ soil material under a radially outer supporting pipe can thus also be removed reliably. This considerably simplifies the introduction of the supporting pipe during cased drilling.

For withdrawal of the drilling tool from the borehole for an emptying process, the receiving opening is closed by rotating the rotary base. In the process, the at least one removal element is returned from the radially outer extension position into the radially inner retraction position by means of the forced control provided. In this way, the drilling tool can be withdrawn reliably and without risk of a collision between the removal element and the supporting pipe.

The invention further comprises a method for producing a bore in the ground in which the above-described drilling tool according to the invention is used. With the method according to the invention, the above-described advantages can be achieved while producing a bore in the ground.

According to the invention, a particularly preferred method variant resides in that the at least one removal element is adjusted radially during drilling by rotating the rotary member of the drilling tool, wherein a bore diameter is changed. A radial extension of the bore can thus be carried out by radially extending the at least one removal element. Inconverse way, with a radial retraction of the at least one removal element into a retraction position, a state of the drilling tool can be achieved in which the drilling tool can be withdrawn through the supporting pipe without problems.

Figure 2:
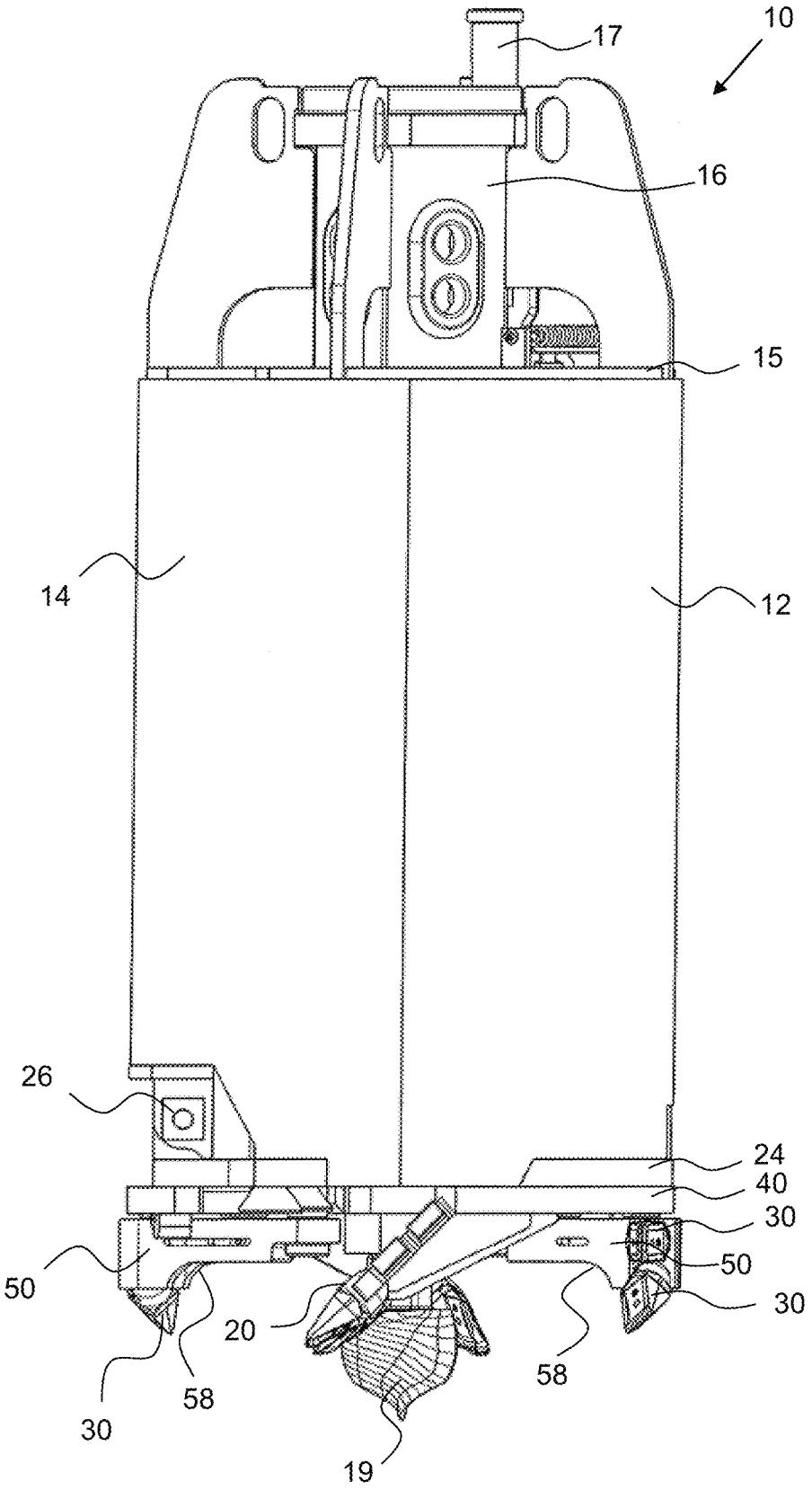
Figure 3:
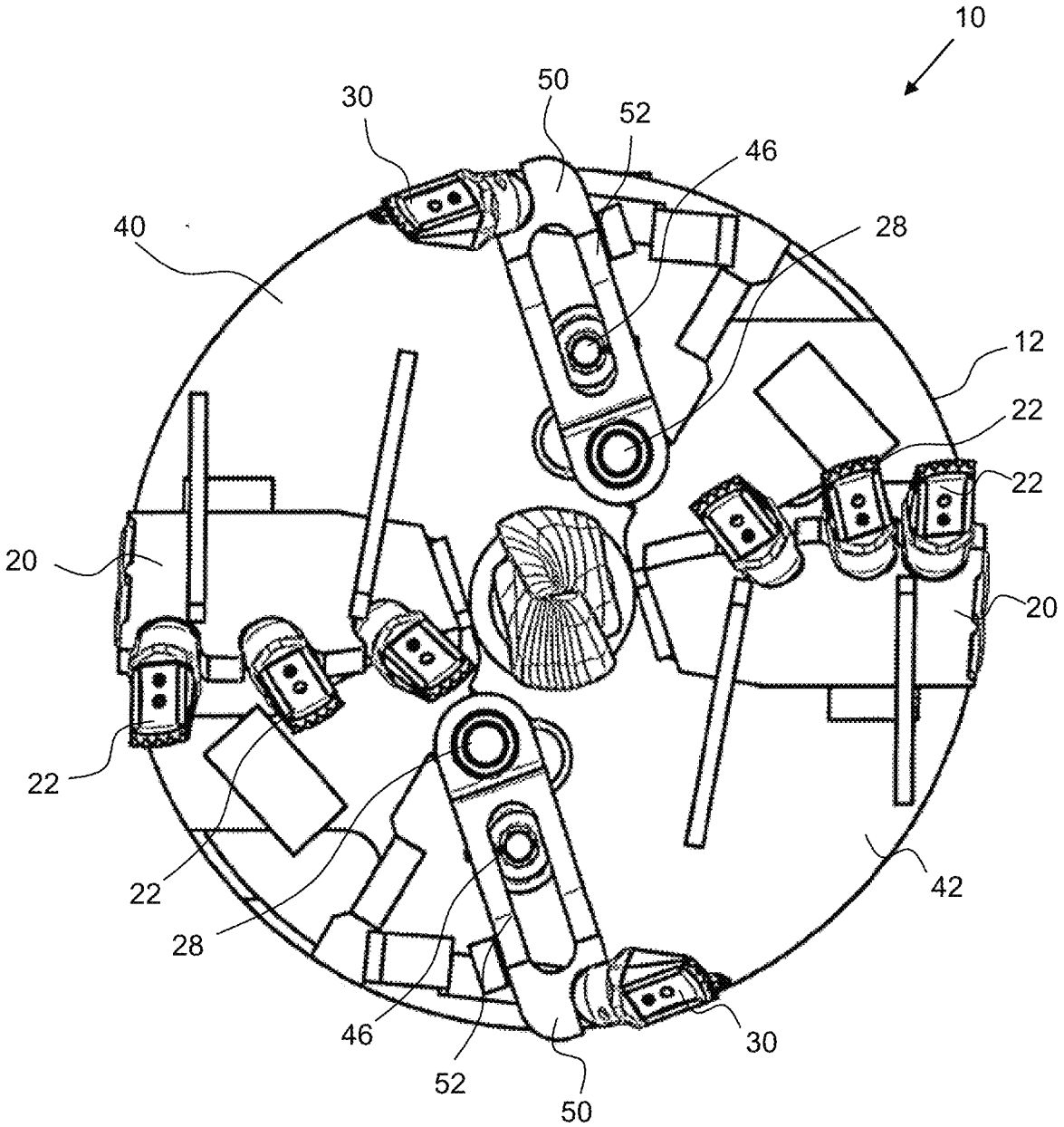
Figure 4:
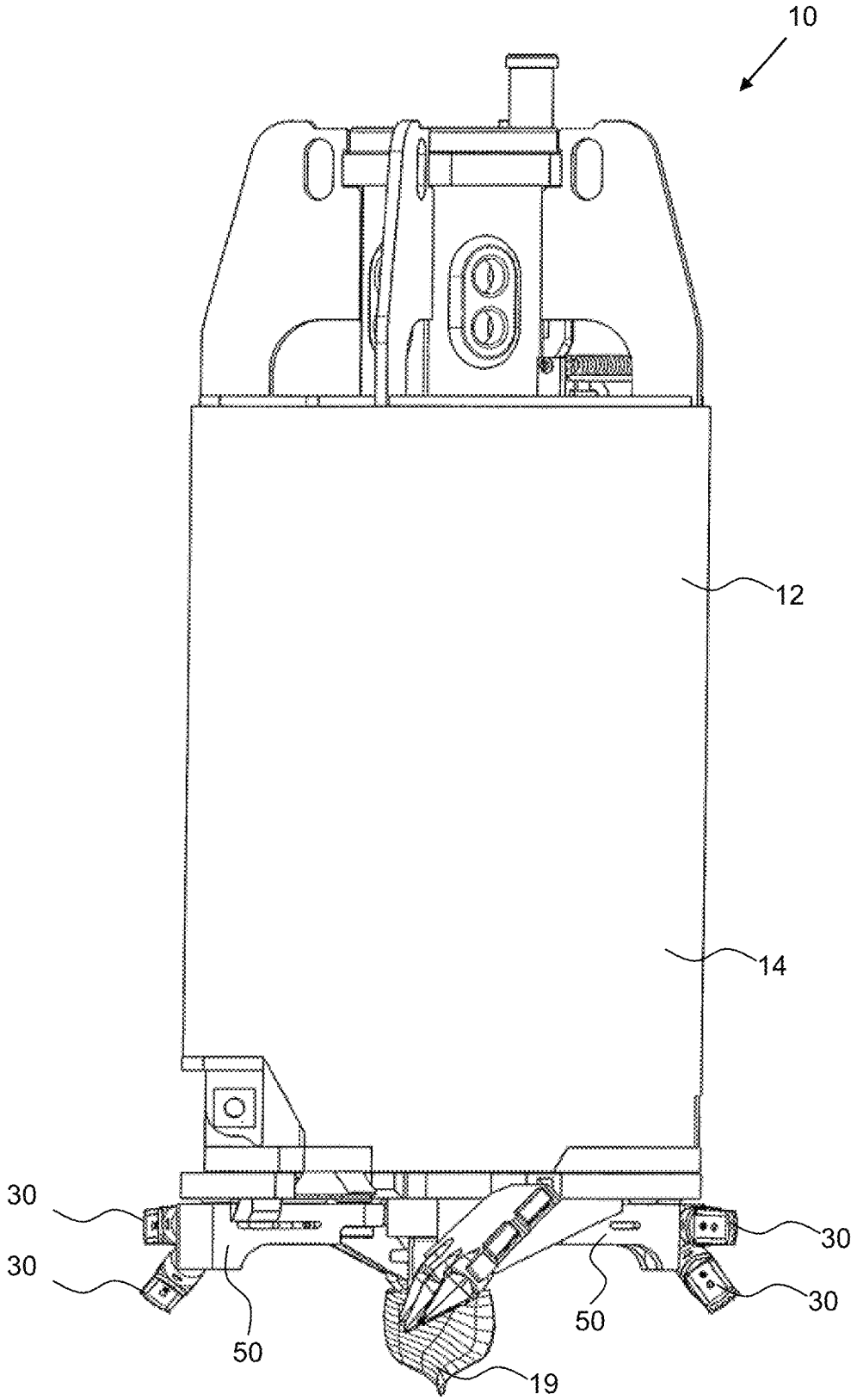
Figure 5:
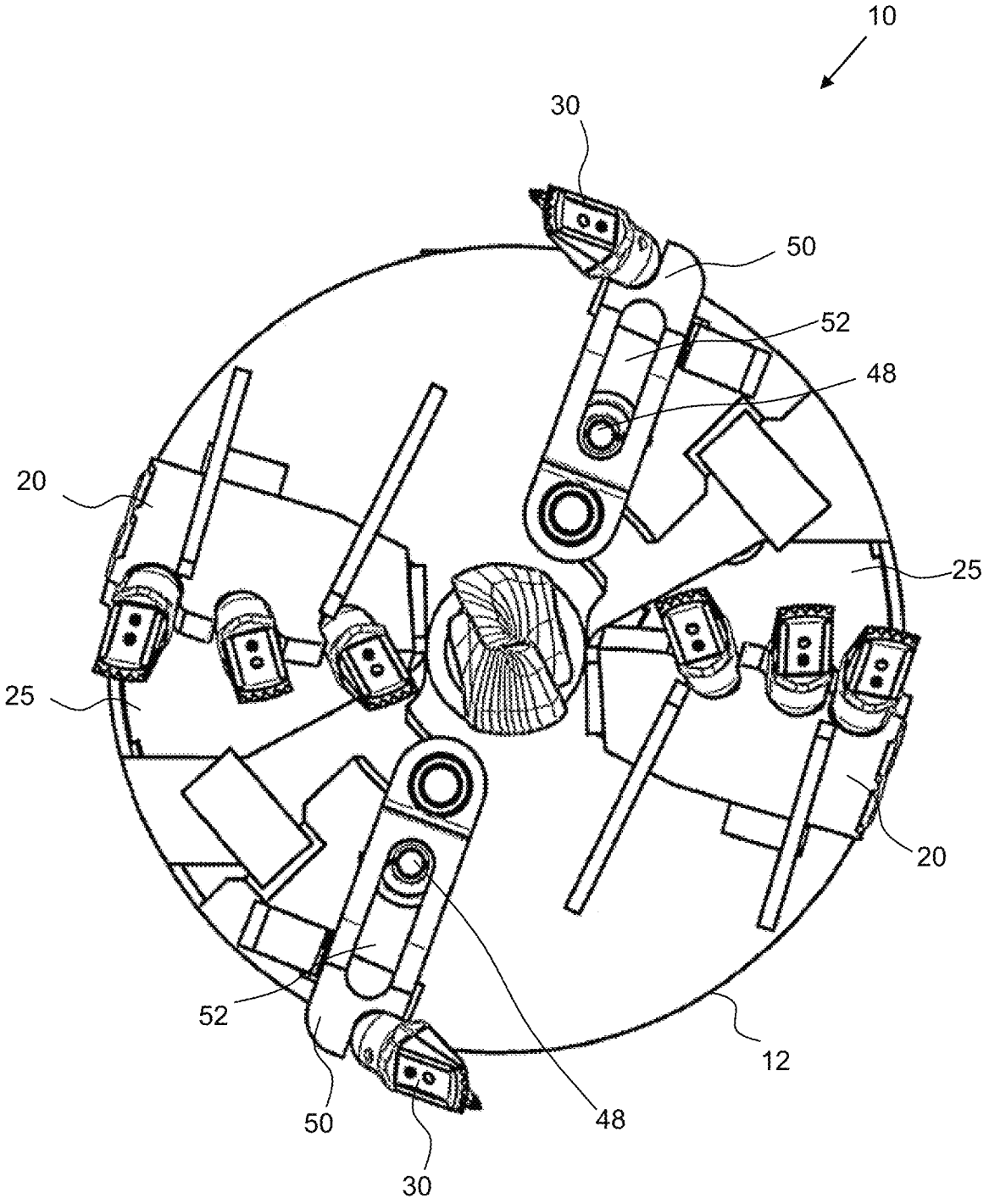

The invention is described further below using a preferred exemplary embodiment, which is shown in the drawings. In the drawings show:

FIG. 1 a first side view of a drilling tool according to the invention;

FIG. 2 a second side view, rotated by 90° from the side view of FIG. 1, of the drilling tool of FIG. 1 with removal elements in the retraction position;

FIG. 3 a view from below of the drilling tool of FIGS. 1 and 2 with removal elements in the retraction position;

FIG. 4 a side view of the drilling tool corresponding to FIG. 2 with radially extended removal elements;

FIG. 5 a view of the drilling tool of FIG. 4 from below; and

Figure 6:
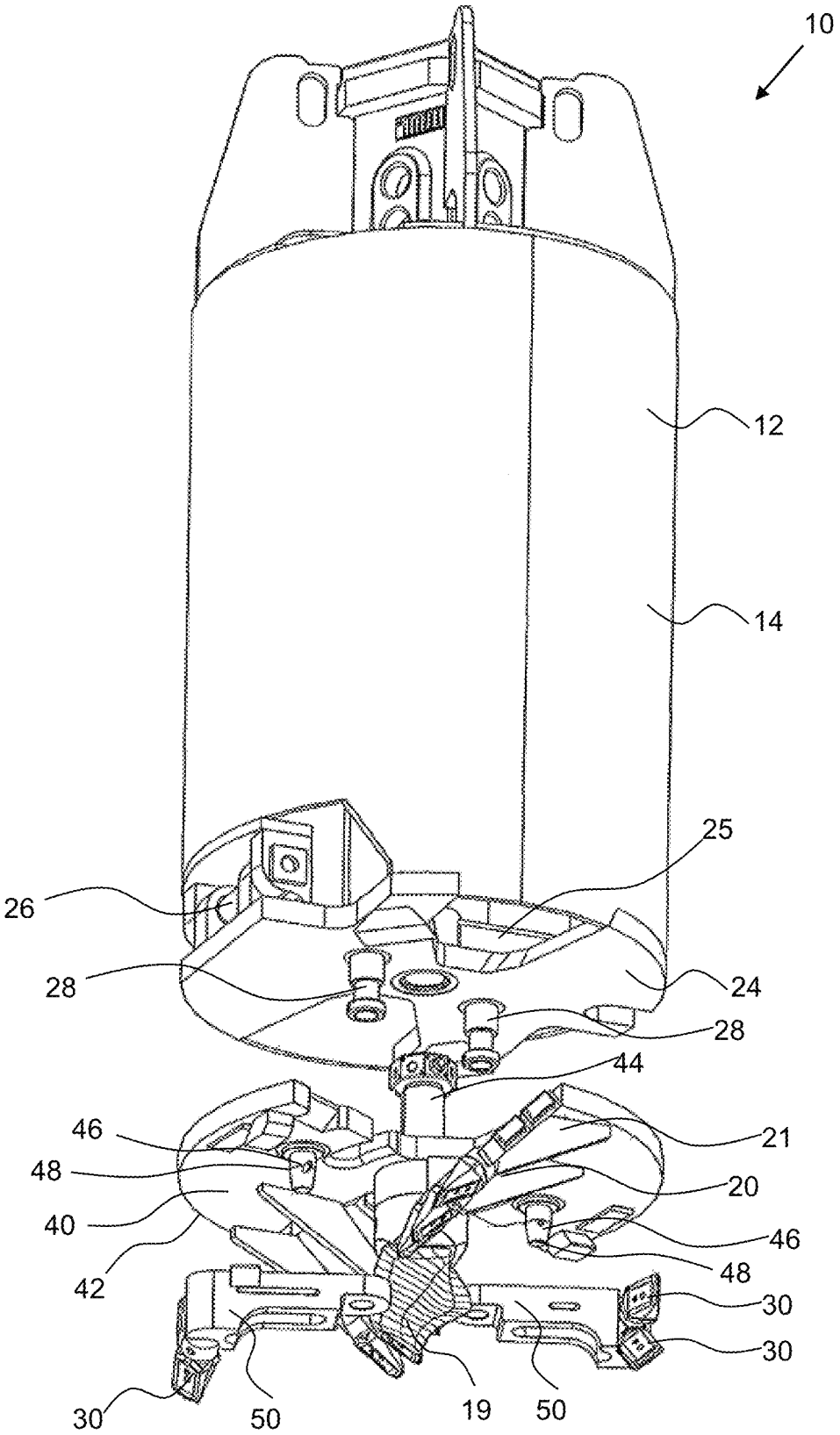

FIG. 6 an exploded perspective view of the drilling tool according to FIGS. 1 to 5.

A drilling tool 10 according to the invention in the state with removal elements 30 in the retraction position is explained below in conjunction with FIGS. 1 to 3. In the exemplary embodiment shown, the drilling tool 10 is configured as a drill bucket with a basic body 12, which comprises a housing-like drum-shaped drilling case 14. In a cover region 15 of the basic body 12, there are positioned, in a manner known per se, a connecting device 16 for releasably attaching drilling rods and an unlocking device 17. The unlocking device 17 is used to unlock and open a folding base 24, which is mounted on the underside of the drum-shaped drilling case 14, so as to be swung open via a hinged joint 26.

The mechanics for unlocking and locking the folding base 24 are known in principle and are not explained in more detail below.

On the folding base 24 on the underside of the basic body 12, a plate-shaped rotary member 40 is mounted rotatably about a central drilling axis between a first rotary position and a second rotary position. In FIGS. 1 to 3, the plate-shaped rotary member 40 is in the first rotary position, in which the adjustable removal elements 30 are in their radially retracted retraction position, as is shown clearly, in particular in FIGS. 2 and 3.

In the retraction position, the removal elements 30 in the form of cutting teeth are retracted radially inwards such that they do not protrude radially relative to the outer circumference of the drum-shaped drilling case 14.

For adjustment of the removal elements 30, they are arranged on two opposing pivot arms 50 in the drilling tool 10. Therefor, the pivot arms 50 are each mounted pivotably on a pivot pin 28 at their radially internal end. The pivot pin 28 is attached fixedly to the folding base 24 and extends parallel to the central drilling axis with a certain radial offset. Furthermore, the pivot arms 50 each have a link hole 52 which extends approximately in the radial direction and is substantially in the form of a slot in the exemplary embodiment shown. In each case two removal elements 30 at angles to one another are attached releasably to the radial outer end of the pivot arms 50.

The strip-shaped pivot arms 50 have a reinforced outer region and a thinner inner region, with a cutout 58 being formed in the inner region of the pivot arm 50. The cutout 58 allows passage of removed soil material below the pivot arm 50.

On the plate-shaped rotary member 40, which is in the form of a rotary base 42, there are arranged two removal means 20 with removal teeth 22, each on one holder 21. The removal teeth 22 in the form of cutting teeth are used to remove in-situ soil material during drilling. A pilot bit 19 for centering the drilling tool 10 during drilling is still arranged on the lower end of the drilling tool 10, in a manner known in principle.

The operating principle of the adjustment mechanism for displacing the removal elements 30 is explained in more detail in conjunction with FIGS. 4 to 6. The two pivot arms 50 are each mounted pivotably about pivot pins 28 which are attached fixedly to the folding base 24 and thus to the basic body 12 of the drilling tool 10. To pivot the pivot arms 50, two actuating cams 46 in the form of pins 48 are attached to the plate-shaped rotary member 40. Here, the pins 48 each engage in the associated link hole 52 in the respective pivot arm 50.

With reference to FIGS. 3 and 5, if the drilling tool 10 is driven in a drilling rotation direction, which is anticlockwise, the plate-shaped rotary member 40 with the removal means 20 attached thereto is adjusted counter to the drilling rotation direction out of the first rotary position according to FIG. 3 into a second rotary position according to FIG. 5. In this second rotary position, two receiving openings 25 in the folding base 24 are exposed, through which the removed soil material can pass into the receiving space in-side the drum-shaped drilling case 14. The rotary member 40 is mounted rotatably on the folding base 24 via a central rotational axis 44.

By means of the rotary movement counter to the drilling rotation direction, the actuating cams 46 in the form of pins 48 are also adjusted in the respective link hole 52 relative to the pivot arms 50 mounted on the folding base 24. As a result of this forced relative movement, the pivot arms 50 with the removal elements 30 attached thereto are adjusted from their radially retracted retraction position according to FIG. 3 into their radially extended extension position according to FIG. 5. In this extension position, the removal elements 30 protrude radially outwards relative to the outer circumference of the drum-shaped drilling case 14, so that the removal elements 30 effect an enlargement of the drilling diameter. The enlargement of the drilling diameter can there be set such that soil material below a supporting pipe (not shown) is removed, so that the supporting pipe can be fed into the borehole in a simplified manner.

When a drilling step is finished, for instance when the receiving space in the drilling case 14 is sufficiently filled with removed soil material, the rotary member 40 in the form of a rotary base 42 can be rotated back again into the first rotary position according to FIG. 3 by rotating the drilling tool 10 backwards counter to the drilling direction in a short-time, that is, clockwise with reference to FIGS. 3 and 5. In the process, the receiving openings 25 are closed at the bottom, so that no soil material can fall downwards out of the receiving space when the drilling tool 10 is pulled out of the borehole.

At the same time as the receiving openings 25 are being closed, the rotation of the rotary base 42 back into the first rotary position causes the pivot arms 50 with the removal elements 30 to pivot back into their retraction position according to FIG. 3. In this retracted position, the drilling tool 10 can problem-free be pulled axially through the supporting pipe positioned from above.

The invention claimed is:

1. Drilling tool for producing a bore in the ground, comprising a rotatably drivable basic body, a removal means at a lower end of the basic body for removing soil material, and at least one adjustable removal element which is adjustable between a radially internal retraction position and a radially external extension position in which the removal element protrudes radially outwards relative to the basic body to widen a bore diameter, wherein for adjusting the removal element there is provided an adjustment mechanism with a rotary member which is rotatable on the basic body about the drilling axis between a first rotary position and a second rotary position, wherein the at least one removal element is arranged on a pivot arm which, relative to the basic body, is pivotable between a first pivoting position, in which the at least one removal element is in its retraction position, and a second pivoting position, in which the at least one removal element is in its extension position, and there is provided on the rotary member and/or on the at least one pivot arm an actuating cam by which a rotary movement of the rotary member can be converted into a pivoting movement of the at least one pivot arm, wherein the basic body has a drum-shaped drilling case with at least one lower receiving opening, and the rotary member is configured as a rotary base for opening and closing the at least one receiving opening.

2. Drilling tool according to claim 1 wherein the at least one actuating cam is configured as a pin.

3. Drilling tool according to claim 2 wherein the actuating cam which is configured as a pin is attached to the rotary member, and on the at least one pivot arm there is formed a link hole in which the pin engages.

4. Drilling tool according to claim 1, wherein on the basic body there is arranged at least one pivot pin on which the at least one pivot arm is pivotably mounted.

5. Drilling tool according to claim 1, wherein two pivot arms with at least one removal element are provided in an opposing arrangement on the lower end of the basic body.

6. Drilling tool according to claim 1, wherein the removal means is arranged on the rotary base.

7. Drilling tool according to claim 1, wherein on a lower region of the drum-shaped drilling case there is arranged in a hinged manner a folding base on which the rotary base is rotatably mounted.

8. Drilling tool according to claim 1, wherein the at least one pivot pin is formed on the basic body as a stop for limiting the rotary movement of the rotary base.

9. Drilling tool according to claim 1, wherein a cutout for forming a passage region for removed soil material is formed on the at least one pivot arm.

10. Drilling tool according to claim 1, wherein the at least one removal element is in the retraction position if the rotary base is closing the at least one receiving opening on the drilling case, and the at least one removal element is in the radially projecting extension position if the rotary base is revealing the receiving opening.

11. Method for producing a bore in the ground, wherein a drilling tool according to claim 1 is used.

* * * * *